US007870830B2

(12) United States Patent
Bogard et al.

(10) Patent No.: US 7,870,830 B2
(45) Date of Patent: Jan. 18, 2011

(54) PONTOON WITH INTEGRATED LIFTING STRAKE AND METHOD FOR MAKING THE SAME

(75) Inventors: Jeff Bogard, Hot Springs, AR (US); David Ashcraft, Sr., Bismarck, AR (US)

(73) Assignee: Xpress Boats, Hot Springs, AR (US)

( * ) Notice: Subject to any disclaimer, the term of this patent is extended or adjusted under 35 U.S.C. 154(b) by 392 days.

(21) Appl. No.: 12/154,979

(22) Filed: May 29, 2008
(Under 37 CFR 1.47)

(65) Prior Publication Data

US 2009/0293790 A1 Dec. 3, 2009

(51) Int. Cl.
*B63B 1/00* (2006.01)

(52) U.S. Cl. ..... 114/292; 114/61.2

(58) Field of Classification Search ..... 114/61.2, 114/61.27, 61.29, 61.32, 292
See application file for complete search history.

(56) References Cited

U.S. PATENT DOCUMENTS

| | | | | | |
|---|---|---|---|---|---|
| D160,027 | S | | 9/1950 | Smith | |
| 3,077,172 | A | | 2/1963 | Domak | |
| 3,208,421 | A | | 9/1965 | Landes | |
| 3,614,937 | A | * | 10/1971 | Schulman | 114/292 |
| 4,192,248 | A | | 3/1980 | Moyer | |
| 4,237,810 | A | | 12/1980 | Westfall | |
| 4,644,890 | A | | 2/1987 | Lott | |
| 4,932,347 | A | | 6/1990 | Mardikian | |
| 5,184,561 | A | * | 2/1993 | Nickell, Jr. | 114/292 |
| 5,265,554 | A | | 11/1993 | Meredith | |
| 5,351,642 | A | | 10/1994 | Ackerbloom | |
| 5,476,061 | A | | 12/1995 | Ackerbloom | |
| 5,575,231 | A | * | 11/1996 | Metcalf | 114/61.29 |
| 5,718,184 | A | | 2/1998 | Holland | |
| 5,746,146 | A | | 5/1998 | Bixel | |
| 5,784,977 | A | * | 7/1998 | Schell et al. | 114/61.32 |
| 5,983,823 | A | | 11/1999 | Allison | |
| 5,988,087 | A | * | 11/1999 | Pepper | 114/61.1 |
| 6,067,923 | A | | 5/2000 | Ratlieff | |
| 6,293,218 | B1 | | 9/2001 | White | |
| 6,516,736 | B1 | * | 2/2003 | Van Lancker | 114/61.1 |
| 6,644,229 | B1 | * | 11/2003 | Davenport | 114/61.1 |
| 6,672,240 | B1 | | 1/2004 | Aube | |
| 6,840,825 | B1 | | 1/2005 | Messano | |
| 6,886,490 | B2 | | 5/2005 | Aube | |
| 6,898,955 | B1 | * | 5/2005 | Davenport | 72/51 |
| 7,188,576 | B2 | | 3/2007 | Bogard | |

OTHER PUBLICATIONS

HyperToon XTC24 Specs, available at http://www.hyperproducts.com/specs.cfm, unknown date.
"An Idea that Started an Industry," Weeres Industries Corp., http://www.weeres.com/about.htm (last visited Oct. 22, 2007).
"PTX Performance," Premiere Marine, Inc., http://www.pontoons.com/ptx_performance/ (last visited Oct. 23, 2007).
"Hull Design," JC Manufacturing, Inc., http://www.jcpontoon.com/hull.html (last visited Oct. 23, 2007).

* cited by examiner

*Primary Examiner*—Lars A Olson
(74) *Attorney, Agent, or Firm*—Nathan Price Chaney

(57) ABSTRACT

A pontoon with an improved running surface and methods for construction the same are provided. The pontoon comprises an interior concave main running surface formed along the longitudinal centerline of the pontoon which is bounded by two sponsons, which in turn are bounded by two distal concave surfaces, or integrated lifting strakes. The associated methods provide a process for retrofitting prior art pontoons or constructing the pontoon to avoid the need for welds below the waterline of the pontoon. The pontoon provides improved pontoon boat performance by maximizing lift and minimizing leakage. The pontoon also reduces construction costs by lowering the number of welds required to form a pontoon with lifting strakes.

11 Claims, 11 Drawing Sheets

FIG. 3
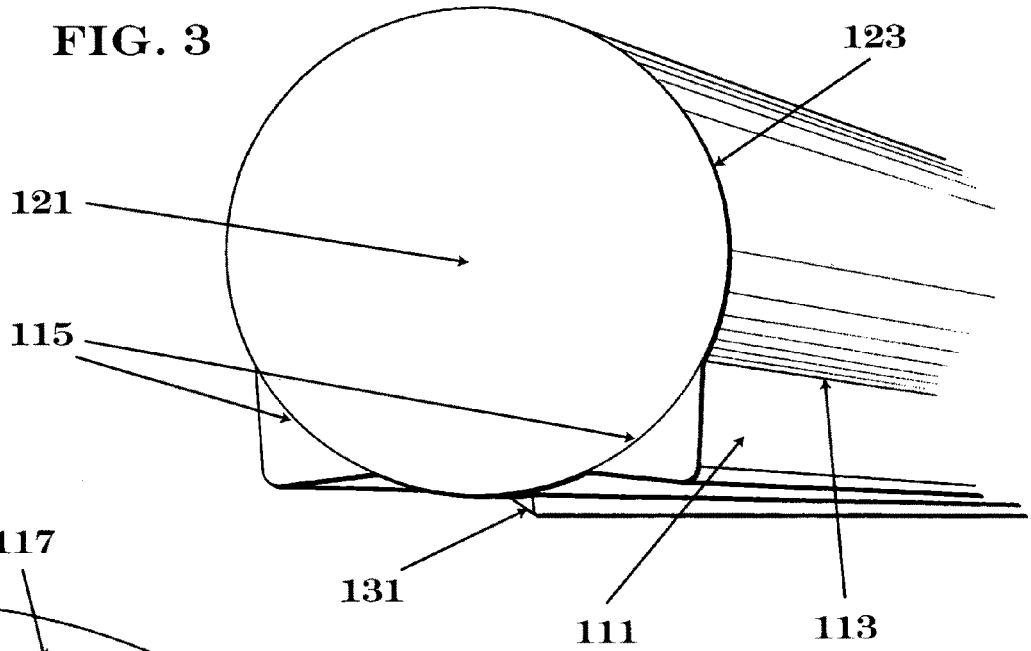
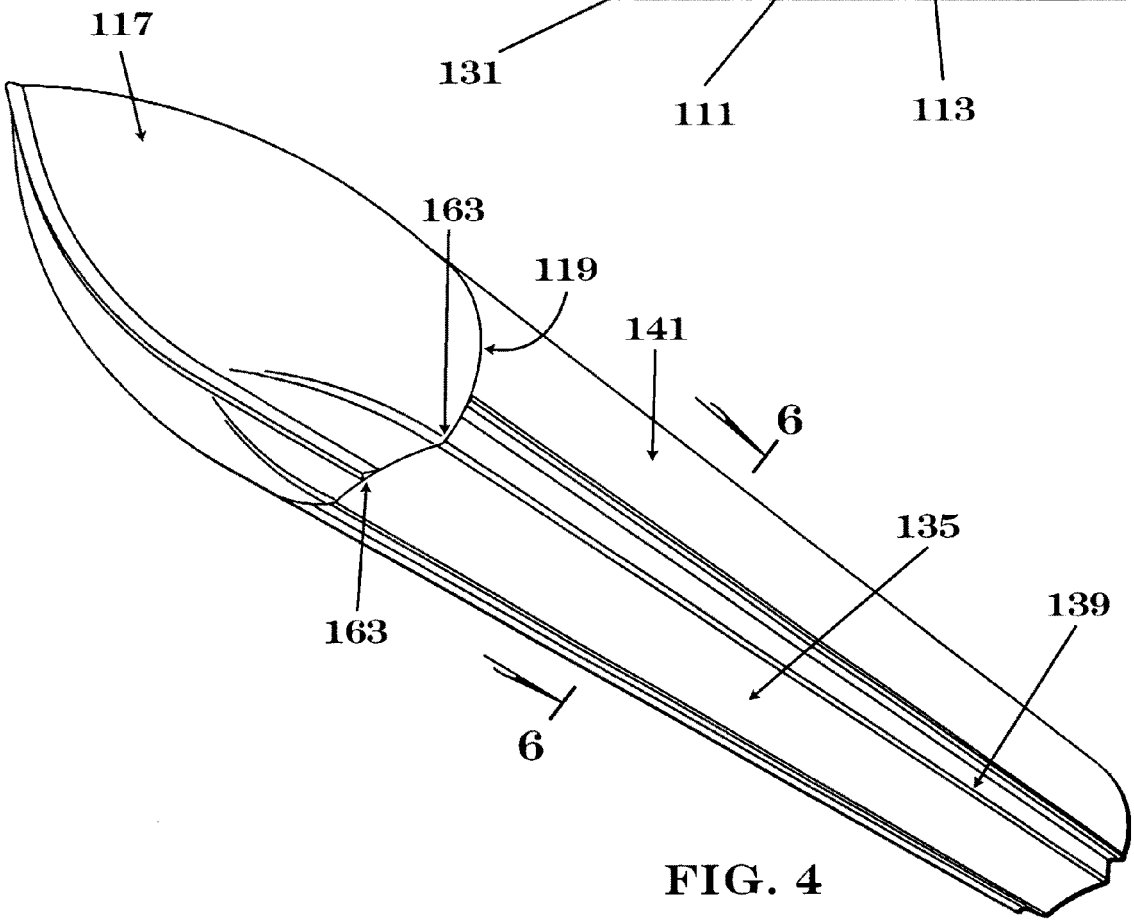
FIG. 4

FIG. 19
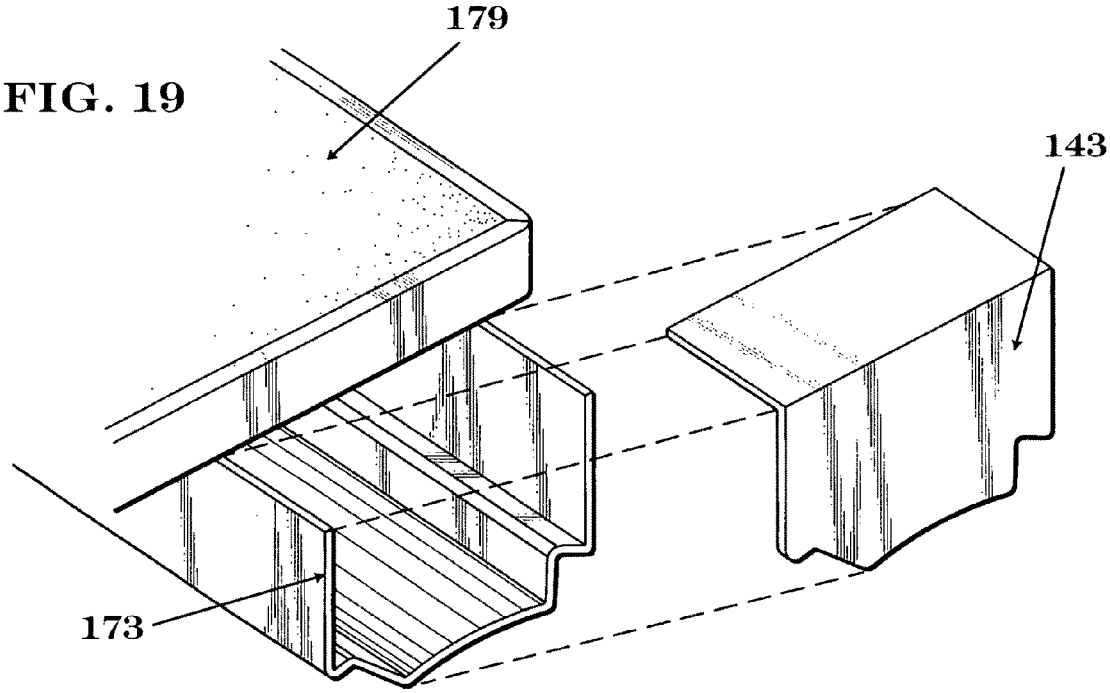
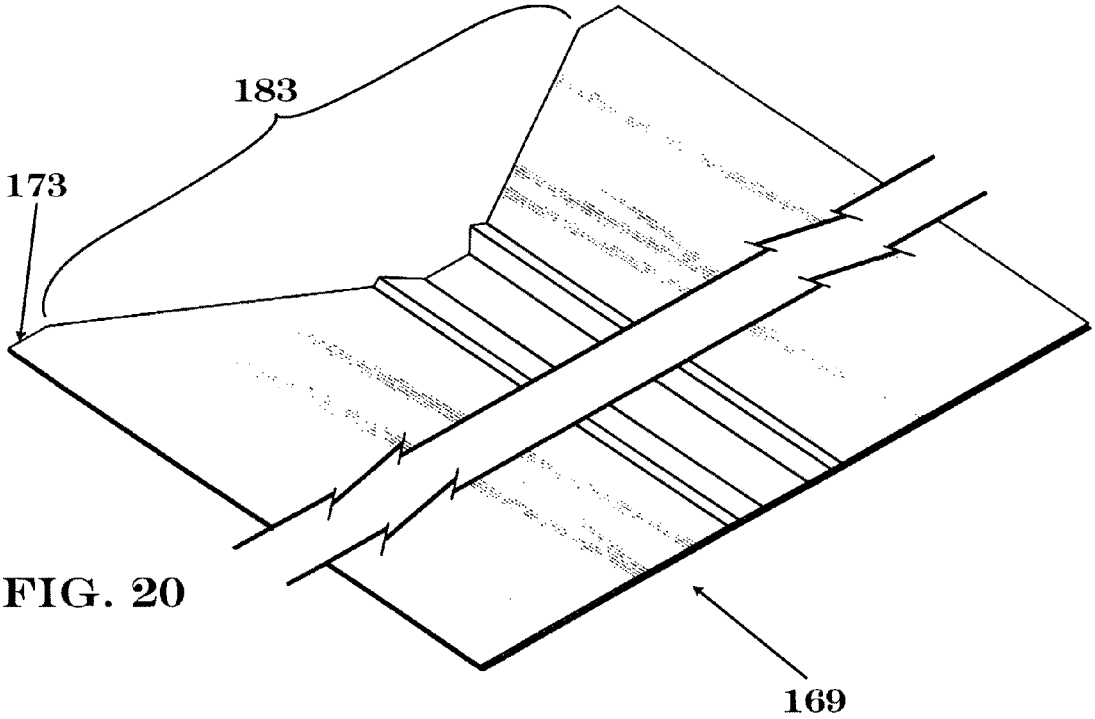
FIG. 20

FIG. 21
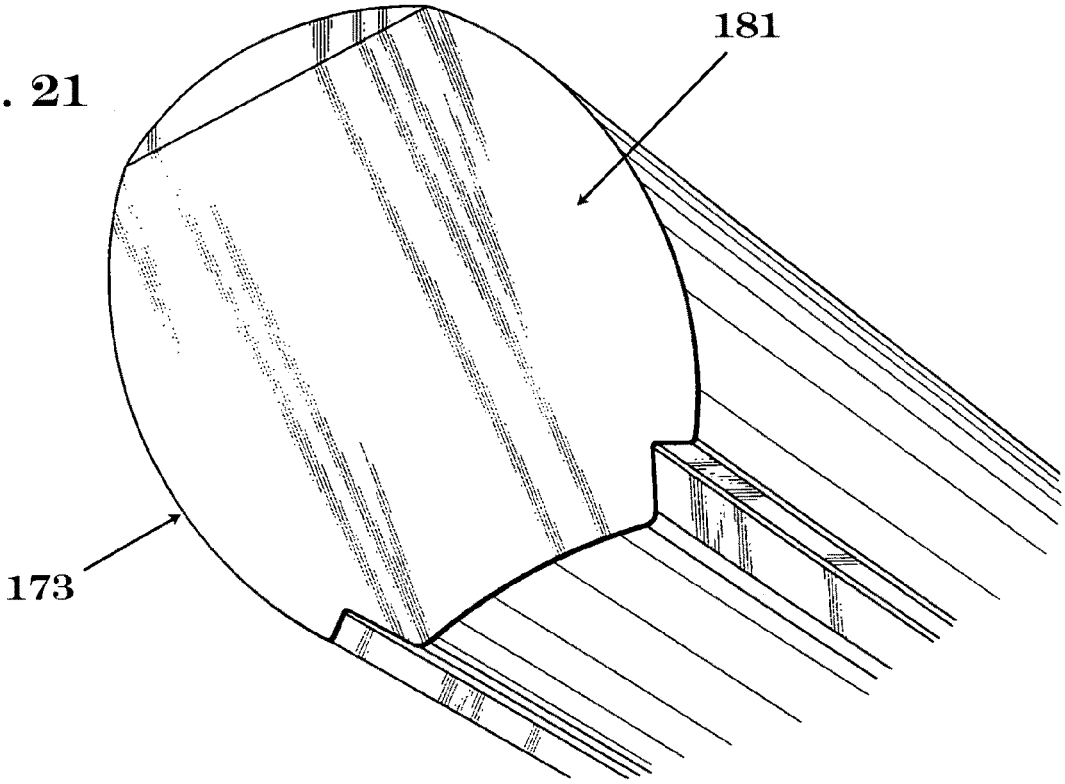
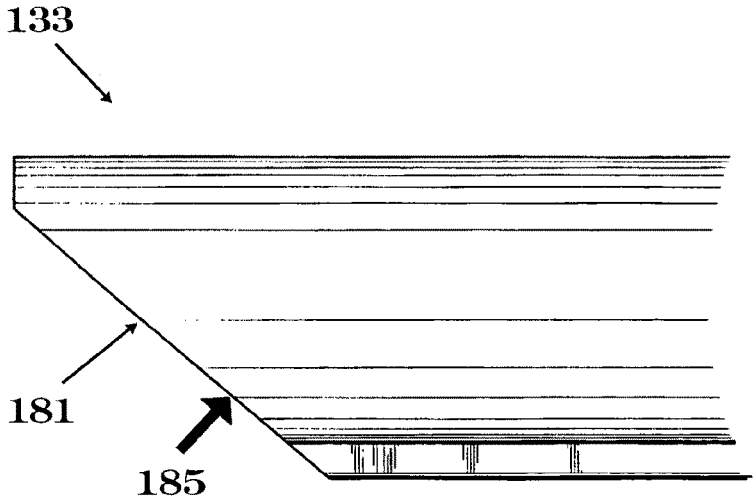
FIG. 22

PONTOON WITH INTEGRATED LIFTING STRAKE AND METHOD FOR MAKING THE SAME

CROSS REFERENCES

None.

GOVERNMENTAL RIGHTS

None.

BACKGROUND OF THE INVENTION

Pontoon boats are popular recreational watercraft that are prized for their ability to carry a large number of persons and a heavy load. Pontoon boats were created at least as early as 1952, when a Minnesota farmer, Ambrose Weeres, assembled the first pontoon boat by attaching a wooden deck to the top of two columns of steel barrels welded together end to end to form a cylindrical pontoon. While the preferred metal for the pontoons may now be aluminum, most pontoon boat companies still utilize Mr. Weeres' simple but obsolete design of wooden decks attached to two cylindrical barrel-shaped pontoons, each having a nose cone and an end cap. It is thus an object of the invention to provide a pontoon boat that improves upon the historical design of a wooden deck attached to a cylindrical pontoon.

Historically, the primary means of improving pontoon boat performance consisted of using a larger motor, which provides more thrust, or adding a third pontoon to the center of a pontoon boat, which reduces drag by giving more pontoon surface area to support the weight of the boat and allowing the boat to float higher in the water. The inventors herein have already made advancements in the field of pontoon boats when compared to the historical art. For example, U.S. Pat. No. 7,188,576, issued to the inventors herein, disclosed a method of constructing a pontoon boat from unique interlocking aluminum planks that improved overall boat performance by reducing weight, lowering deck height, and improving rigidity of the overall structure. While these design changes improved pontoon boat performance, such changes did not address the problems that arise from the continued use of traditional cylindrical pontoons. It is desirable for the performance of pontoon boats that the pontoons generate lift. However, cylindrical pontoons of the prior art generate very little lift because the bottom surface of the cylindrical pontoon is rounded. It is thus an object of the invention to provide improved lift qualities to pontoon design.

A pontoon of the prior art typically has at least three components; a nose cone, a number of barrels joined by circumferential welds, and an end cap. The nose cone is typically constructed by forming two nose cone halves, a right and left half. The respective nose cone halves are then welded together along the vertical axis to form the nose cone piece. The position of the weld seam joining the two nose cone halves together presents a possible leakage point because the weld seam runs the length of the nose cone, thereby extending below the water level. Accordingly, the nose cone weld seam is subjected to water and water pressure as the pontoon boat travels through the water. Further, because the nose cone is the most likely location for damage following any sort of collision, such as by running aground, the weld seam is prone to damage and subsequent leakage. It is thus an object of the invention to provide a pontoon with an improved, single-piece nose cone design that does not require a weld seam joining two nose cone halves that is located at the point most likely to suffer predictable damage.

The body of a pontoon is generally constructed from a number of barrel segments. Typically, a pontoon barrel segment is created from a flat rectangular piece of metal that is shaped into a cylinder and joined by a longitudinal weld seam. A typical pontoon is thereafter constructed of two or more pontoon barrels joined at one or more ends using circumferential welds. The barrel-joining circumferential welds are oriented perpendicular to the length of the pontoon, and when the pontoon barrels are welded together, they form a long cylindrical pontoon body to which the nose cone and end caps are attached using circumferential weld seams. Together, when the unit is completed, it is referred to as a pontoon.

Pontoons should be watertight, and although most modern pontoons are filled with foam or other types of floating material to avoid sinking, even slightly leaky pontoons greatly reduce pontoon boat performance due to the relatively high weight of water. Any weld length is a potential source of a leak for a pontoon. For this reason, it is preferred to situate the longitudinal welds above the water surface. With this method of construction, the only welds that routinely come in direct contact with the water are the circumferential welds that join the barrels and the nose cone and end cap to the barrels.

The circumferential weld joining the nose cone to the cylindrical body also presents a potential structural strength problem because the upward force of the water, the forces caused by running the nose cone area aground, are not spread equally across the entire weld; rather, the upward force upon the nose cone tends to compress or stretch various locations of the circumferential weld. It is thus an object of the invention to alleviate the unequal stresses associated with circumferential welds joining the nose cone to the cylindrical body.

In an attempt to improve upon the cylindrical body designs of the prior art and to address poor planing characteristics of pontoon boats in general, in the last decade the pontoon boat industry began welding to the surface of the cylindrical body one or more longitudinal strakes at or below the water surface. As a pontoon boat is typically powered by a rear-mounted engine, the strakes were designed to direct water downward, thus tending to improve the planing characteristics of the traditional cylindrical body by generating lift. Strakes of the prior art represent a rather crude fix to the known problems because most of the running surface of the cylindrical body remained convex.

The limitations to a convex pontoon design can be illustrated by an analogy to treatment of light by a lens: convex lenses scatter light, whereas concave lenses focus light. In pontoons, convex surfaces scatter water pressure away from all sides of the pontoon, whereas concave surfaces directs water pressure downward, thereby generating lift (the direction of force applied by the pontoon upon the water can described by a vector field). It is thus another object of the invention to provide a pontoon design that maximizes lift.

There are clear drawbacks to using after-applied lifting strakes, because if two strakes are used, then at least four longitudinal welds are typically required. Each of the two longitudinal sides of each strake must be attached to the bottom surface of the pontoon. There are many problems associated with welding strakes to existing pontoons, including that each weld increases the susceptibility of leakage in the pontoon in the event a weld is not within acceptable tolerances. This stepwise manner of construction is also time-consuming because it requires a large number of total weld lengths for the pontoon. That is, on a typical pontoon there are longitudinal welds for the creation of the barrel and at least four longitudinal welds for the attachment of two lifting strakes. It is thus another object of the invention to provide a pontoon design that requires a minimal number of longitudinal welds while at the same time adopting the lift and planing advantages offered by strakes.

While pontoon makers have remained relatively traditional in the shape of pontoon hulls, some inventors have experimented with hull shapes in other types of watercraft. However, the problems presented for distinct types of watercraft are markedly different than those faced by pontoon boats, and accordingly the solutions to such problems are likewise different. For instance, U.S. Pat. No. 3,208,421 (the "'421 patent"), issued to W. K. Landes et al., discloses a seaplane float that changes shape from front to rear to reduce drag. The front part of the float has a main concave channel and two smaller concave channels on each side of the main concave channel. The rear portion of the float has two distinct, flat keel pads. In the '421 patent, the inventors used two concave channels. When the seaplane float is viewed from the side, the front of the float tapers into a narrow, aerodynamic trailing edge. The minimal trailing edge of the seaplane float is made possible because the center of gravity of a seaplane is near the front due to the heavy weight of the engine when compared with the lighter weight of the tail of the seaplane. The concerns for a pontoon boat are opposite the concerns facing the inventor for the seaplane float design. The engine on a pontoon boat is in the rear, requiring substantial rear flotation. It is therefore an object of the invention to provide sufficient rear flotation to accommodate engine weight and thrust typical to pontoon boating.

The design of the hull on the seaplane float depicted by Landes defines a separation between three concave channels along the length of the hull. This design allows the seaplane to advantageously ride on the keels alone during high speed takeoff; yet for an aluminum pontoon boat such a design is impractical and undesirable due to the fact that such keel types would impugn the integrity of the concave running surface. It is therefore an object of the invention to provide a fully concave running surface without flat keels to maximize downward force when the pontoon boat is under power.

Sea planes take off and land at relatively high speeds, which require higher curvature of the center concave channel for maximum convergence of water in the twin rear channels to provide lift. It is thus an object of the invention to provide a pontoon that minimizes drag while at the same time providing ample flotation to support an engine mounted at the rear of a pontoon boat.

U.S. Pat. No. 6,293,218 (the "'218 patent"), issued to R. F. White, provides a concave tunnel-hulled boat that utilizes lifting strakes. Like the seaplane float, the tunnel changes shape from fore to aft; also, the leading edge of the tunnel is formed from two concave channels which tapers to one concave channel as the tunnel progresses rearward. The objective of the concave tunnel for which the '218 patent was to mount a motor higher on the transom of the boat, thus providing a shallow draft and minimizing propeller damage in shallow waters. This tunnel-hulled boat requires the additional use of sponsons to replace the buoyancy necessarily lost by implementing a tunnel into the tunnel-hulled boat. The '218 patent further requires relatively flat surfaces for the remainder of the hull of the boat such that the concave tunnel is merely one component of the overall hull design. It is thus an object of the invention to provide a sufficiently buoyant pontoon for which the entire running surface is generally concave, rather than merely having a localized concave tunnel as a feature of an otherwise rounded or flat pontoon.

U.S. Pat. No. 6,067,923 (the "'923 patent"), issued to Ratcliff, provides a hull configuration for a catamaran boat. The design of such hull is divided such that the forward two-thirds of each hull is V-shaped, which such V-shape being very pronounced at the front of the keel. Like the seaplane and the tunnel-hulled boat discussed above, the catamaran's hull tapers toward the rear, and the rear of the hull has a flat keel pad and flat lifting strake pads separated by ridges. Each ridge in the catamaran hull requires three distinct points at which the surface abruptly changes; these three angles adversely affect performance because the flow of water from the sharply angled ridge moves toward a different point than water moving over the flat keel, which generates turbulence. It is thus an object of the invention to provide a smoothly curved running surface which provides more lift for pontoon boats. It is thus an object of the invention to provide a large, smoothly curved, concave running surface for a pontoon such that the transition between running surface and lifting strake requires a minimum number of sharp angles.

The apparatus in accordance with the invention provides a concave pontoon that provides improved pontoon boat performance by maximizing lift and minimizing leakage by reducing weld length exposed to the water. The invention also provides reduced construction costs because it lowers the number of welds required to form a pontoon with lifting strakes.

BRIEF SUMMARY OF THE INVENTION

An apparatus and associated method for producing an improved pontoon is provided. The pontoon comprises a concave main running surface having a centerline that is perpendicular to the surface of the water, the main running surface being bounded by two sponsons, which in turn are bounded by two distal concave surfaces, or integrated lifting strakes. Thus, the invention provides at least three surfaces that direct water substantially downwardly perpendicular to the surface of the water, which provides maximum lift. The associated method of construction of this improved pontoon design has five preferred embodiments.

The first preferred embodiment for construction of the improved running surface and integrated lifting strake is formed as one main longitudinal insert. Each of the two longitudinal edges of the insert offer a receiving flange along the entire length of the insert. In order to construct the remainder of the cylindrical body, a single sheet of material, preferably aluminum or an alloy thereof, is cut to a length that corresponds to the insert and is shaped into a semi-circular barrel. The longitudinal edges of the cylindrical body are inserted into the receiving flange and thereafter joined with a welded seam. A nose cone and a rear cap are joined to complete construction of the pontoon. This first preferred embodiment has an additional advantage in that it is capable of being retrofitted to pontoons of the prior art.

In the second preferred embodiment the entire length of a pontoon body, with the exception of the nose cone and end cap, is constructed using one relatively flat, rectangular piece of material, preferably aluminum or an alloy thereof. The improved running surface and integrated lifting strakes are formed using a metal press along the longitudinal centerline of the material, and the two substantially equal amounts of flat material remaining are then shaped to form the remainder of the cylindrical body of the pontoon. The material is thereafter joined into the cylindrical shape with a welded seam. Such welded seam is preferably located along the top longitudinal edge of the pontoon cylinder. A nose cone is thereafter joined onto the front portion of the pontoon cylinder, and a rear cap is also joined, thus completing construction. This design requires only one longitudinal seam to form the pontoon cylinder, one seam joining the nose cone to such cylindrical body, and one seam joining the end cap to the cylindrical body. The longitudinal weld is located on the top surface of the pontoon and out of the water.

In the third preferred embodiment the entire length of a pontoon cylinder is also constructed from one relatively flat, rectangular piece of material, preferably aluminum or an alloy thereof. The preferred running surface with integrated lifting strake is formed offset to one side of the starting material. As part of the forming process, a flange may be incorporated into the design to receive the corresponding material edge, thereafter joined by welded seam. A nose cone is thereafter joined onto the front portion of the pontoon cylinder, and a rear cap is also joined, completing construction. This design requires only one longitudinal seam to form the pontoon cylinder, one circumferential weld seam joining the nose cone to such cylinder, and one circumferential weld seam joining the end cap to the cylinder.

In the fourth preferred embodiment the entire length of the pontoon cylinder is constructed from a single sheet of relatively flat material, preferably aluminum or an alloy thereof. Like the second preferred embodiment, the improved running surface with the integrated lifting strake is formed along the longitudinal centerline of the material. However, in the fourth preferred embodiment, the remaining portions of the material adjacent to the improved running surface are shaped substantially perpendicular to the running surface. The pontoon cylinder is thereafter welded to the bottom of a metal deck, thereby securing the entire length of the pontoon cylinder directly to the deck. The longitudinal edges of the pontoon cylinder may be flanged to facilitate a strong attachment between the pontoon cylinder and the deck. This design eliminates the need for extra material (and weight) required by the top of a pontoon and by mounting brackets used to attach the deck to the pontoon. When used in a method of construction with the modular interlocking deck that is the subject of another patent by the inventors, the third preferred embodiment obviates the need for additional structural reinforcement. Depending on the final desired shape of the sides, a strengthening strut or internal baffles may be added. A nose cone is applied to the front and a rear cap is joined to the rear to seal the pontoon cylinder, which completes construction. This design requires only two longitudinal seams formed between the deck and the pontoon cylinder, neither of which will be exposed to water, and has the further advantage of obviating the need for mounting brackets and adding structural integrity and stiffness to the overall pontoon boat.

In the fifth preferred embodiment the entire length of a pontoon is constructed from one relatively flat, rectangular piece of material, preferably aluminum or an alloy thereof. At the end designed to serve as the nose of the pontoon cylinder, a W-shaped tab is removed from the relevant center portion of the transverse side of the metal sheet. The improved running surface with the integrated lifting strake is thereafter formed along the longitudinal centerline of the metal. The two remaining unformed sides are thereafter shaped until the longitudinal edges of the material abut one another and are joined with a longitudinal welded seam. When the cylindrical body is formed from the solitary piece of metal cut in this fashion, the W-shaped tab forms a substantially flat angled surface to which a one-piece front cap may be welded. The one-piece front cap may be substantially flat or it may have some curvature. In this fifth preferred embodiment, because the one-piece front cap is not constructed of two halves, the force of the water may be spread evenly over the welds securing the one-piece nose cap, and the one-piece nose cap works in conjunction with the integrated lifting strake to provide even more lift than the pontoon with integrated lifting strake alone.

Each preferred embodiment is useful in pontoon boats with two or more pontoons. Each preferred embodiment can also be constructed using more traditional methods, such as creating the pontoon using multiple barrels, each having the improved running surface incorporated therein, and then welding the barrels together. Further, each of the embodiments contemplates that the location of the improved running surface and lifting strake can be formed into an arbitrary longitudinal location on the material (i.e., not the center or one side of the material), if desired, to change the locations of the seams with respect to the running surface.

These and other advantages provided by the invention will become apparent from the following detailed description which, when viewed in light of the accompanying drawings, disclose the embodiments of the invention.

BRIEF DESCRIPTION OF THE DRAWINGS

FIG. 3 is a rear perspective view of a pontoon of the prior art.

FIG. 4 is a bottom perspective view of the pontoon with integrated lifting strake.

FIG. 19 is a perspective view of the pontoon with integrated lifting strake after being joined to the pontoon boat deck according to the fourth preferred embodiment of the invention.

FIG. 20 is a perspective view of a piece of material, the W-shaped notch, and the several bend points used to construct the pontoon with integrated lifting strake according to the fifth preferred embodiment of the invention.

FIG. 21 is a perspective view of the pontoon with integrated lifting strake being rounded into a pontoon shape and showing installation of the nose cone and end cap according to the fifth preferred embodiment of the invention.

FIG. 22 is a side view of the pontoon with integrated lifting strake showing installation of the nose cone and end cap according to the fifth preferred embodiment of the invention.

LISTING OF COMPONENTS

101—pontoon boat
103—deck
105—cylindrical body
107—mounting brace
109—convex running surface
111—longitudinal strakes
113—longitudinal strake weld
115—transverse strake weld
117—nose cone
119—nose cone circumferential weld seam
121—rear end cap
123—rear end cap circumferential weld seam
125—nose cone halves
127—nose cone center weld seam
129—high risk area
131—protective strap
133—pontoon with integrated lifting strake
135—improved running surface
137—improved running surface centerline
139—integrated lifting strake
141—flotation cavity wall
143—nose
145—end
147—sponson
149—proximal lifting strake surface
151—sponson angle
153—proximal lifting strake edge
155—distal lifting strake surface
157—distal lifting strake edge
159—transverse centerline
161—lifting strake angle
163—rear nose edge
165—insert
167—flange
169—metal sheet
171—longitudinal edges
173—transverse edges
175—flotation cavity seam
177—flotation cavity seal
179—deck
181—nose cap
183—tab
185—water pressure

DETAILED DESCRIPTION OF THE INVENTION

The invention as disclosed herein provides a pontoon with an improved running surface. The improved running surface comprises a concave main running surface having a centerline that is perpendicular to the surface of the water, further bounded by two sponsons, which in turn are bounded by two distal concave surfaces, or integrated lifting strakes. Thus, the invention provides at least three surfaces that direct water substantially downwardly perpendicular to the surface of the water, which provides maximum lift. The invention also includes several methods of manufacturing the pontoon, with the goal of such methods being to minimize the number of welds required in the manufacturing process, avoiding the number of welds exposed to water, and providing higher quality control by using automated manufacturing systems.

Figure 1:
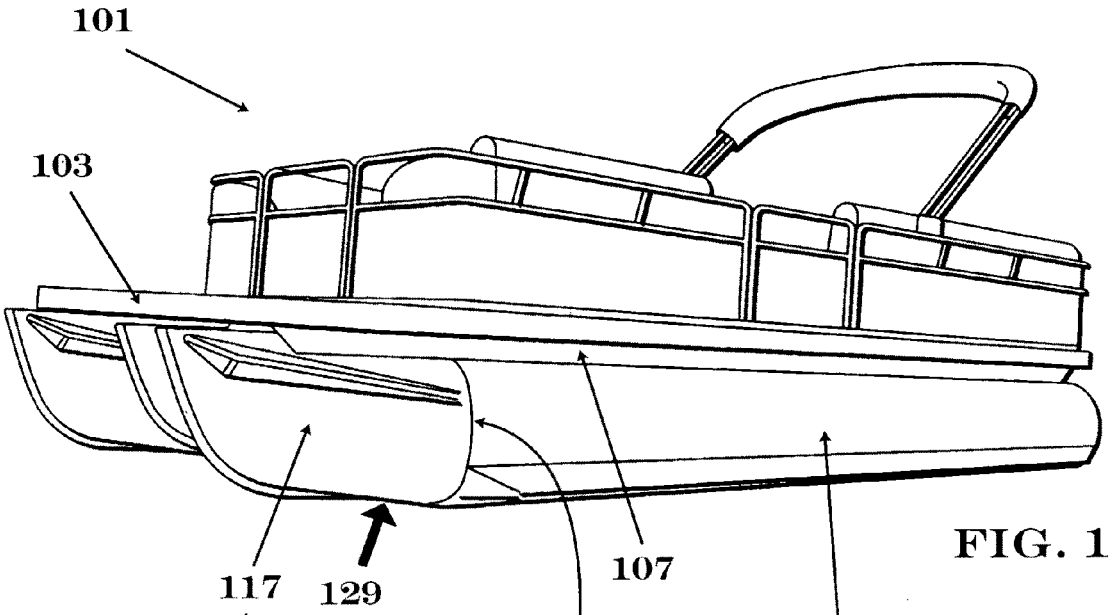
FIG. 1 is a perspective view of a pontoon boat of the prior art.

Referring now to the drawings, FIG. 1 depicts a pontoon boat 101 of the prior art. According to traditional designs and methods of manufacture, pontoon boats consist of a deck 103 mounted to one or more prior art pontoons 105. In almost all prior art pontoon boats, pontoons 105 are metal, while deck 103 is constructed using marine-grade plywood; the difference in materials necessitates the use of brackets or braces 107 to attach deck 103 to pontoons 105.

Figure 2:
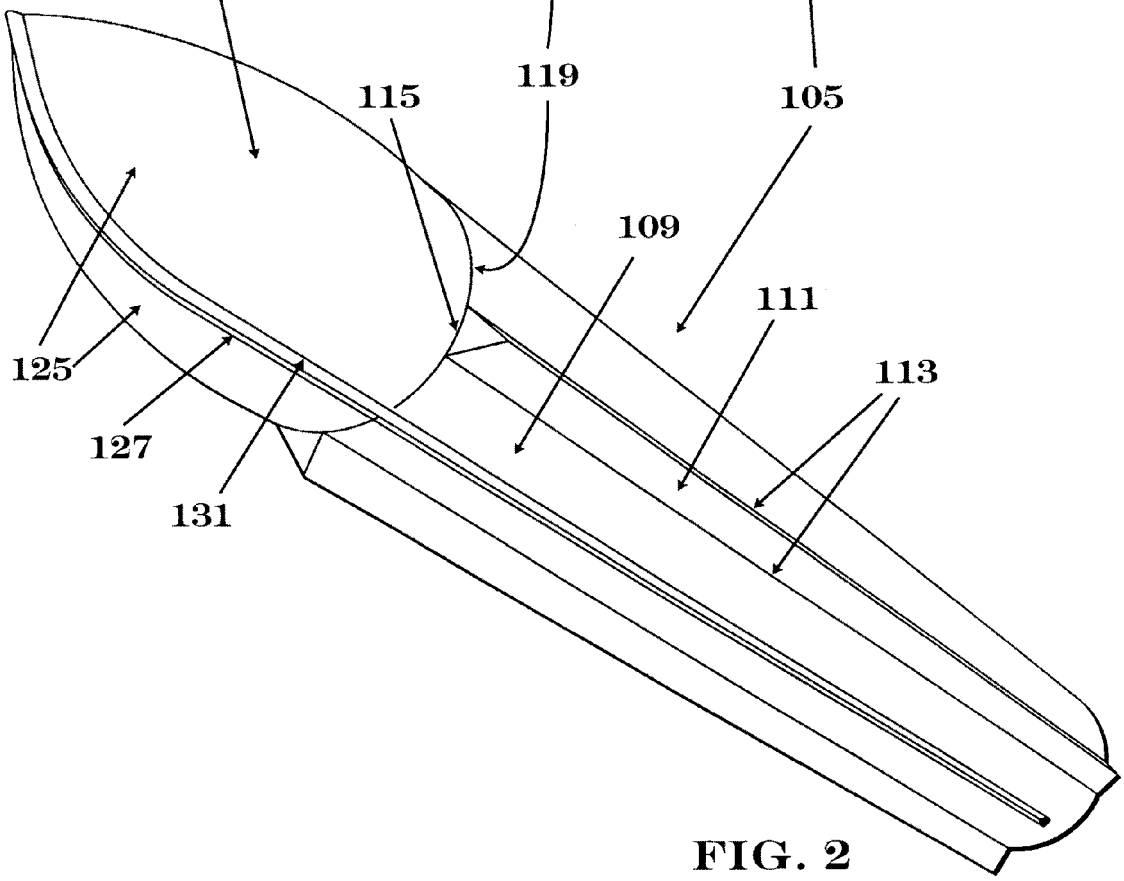
FIG. 2 is a bottom perspective view of a pontoon of the prior art.

Referring now to FIGS. 2 and 3, prior art pontoon 105 has a convex running surface 109, the deficiencies of which include that the convex running surface 109 does not direct water downward in a manner that assists with lift. In order to provide downward force, prior art designs added long strips of metal, or longitudinal strakes 111, to pontoon 105. Manufacturing methods used to apply longitudinal strakes 111 to the convex running surface 109 are undesirable because each longitudinal strake 111 requires two longitudinal strake welds 113 as well as two transverse strake welds 115; further, longitudinal strakes 111 only partially alleviate the limitations of convex running surface 109.

In prior art manufacturing techniques, a nose cone 117 is joined to pontoon 105 via nose cone circumferential weld seam 119, as well as a rear end cap 121 that is joined to pontoon 105 via rear end cap circumferential weld seam 123. Nose cone 117 (shown in FIG. 1) is typically constructed from two nose cone halves 125; the two nose cone halves 125 are secured to each other using nose cone center weld seam 127. Prior art nose cone 117 is undesirable, in part, because when pontoon boat 101 is under power and moving forward, high risk area 129 (shown in FIG. 1, delineated by an arrow in the direction of such high risk area 129) exerts a force on nose cone 117 that is substantially perpendicular to the surface of nose cone 117. Beaching the pontoon boat 101 onto shallow ground in order to enjoy a beach, for example, is common practice to many pontoon boat enthusiasts, but such usage of a pontoon boat also exerts force and trauma upon the high risk area 129. When such force is applied, either intentionally or unintentionally, nose cone 117 acts as a lever and exerts a force on nose cone circumferential weld seam 119 that is greater at the bottom of pontoon 105 than at the top of pontoon 105. This force differential causes stress fractures in nose cone circumferential weld seam 119 and to minimize this effect, many prior art pontoons 105 utilize protective strap 131 to protect the nose cone center weld seam 127 and the nose cone circumferential weld seam 119.

Figure 5:
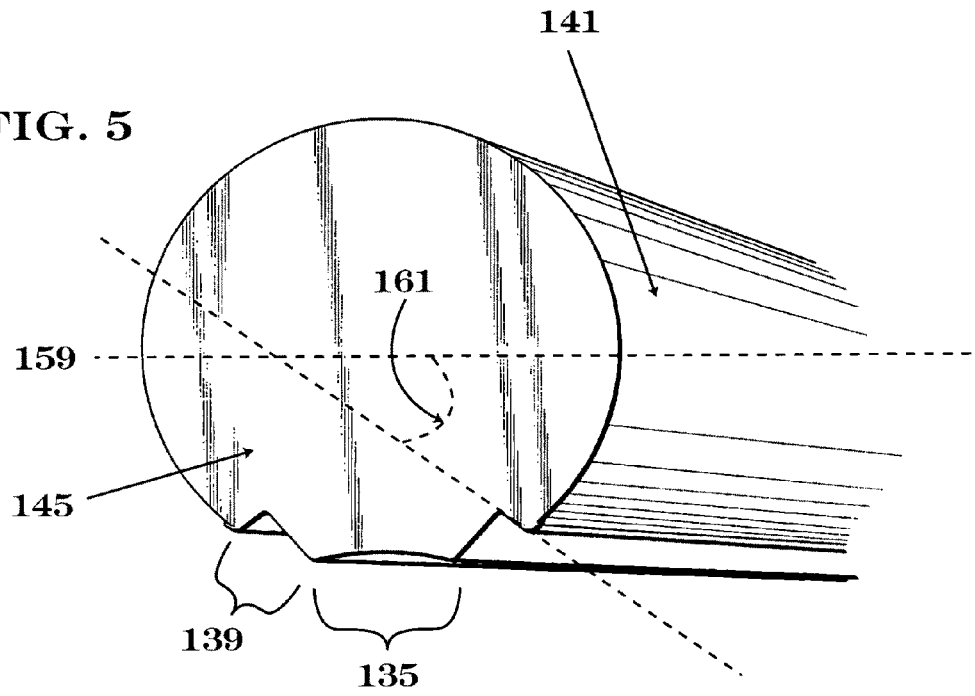
FIG. 5 is a rear perspective view of the pontoon with integrated lifting strake.
Figure 6:
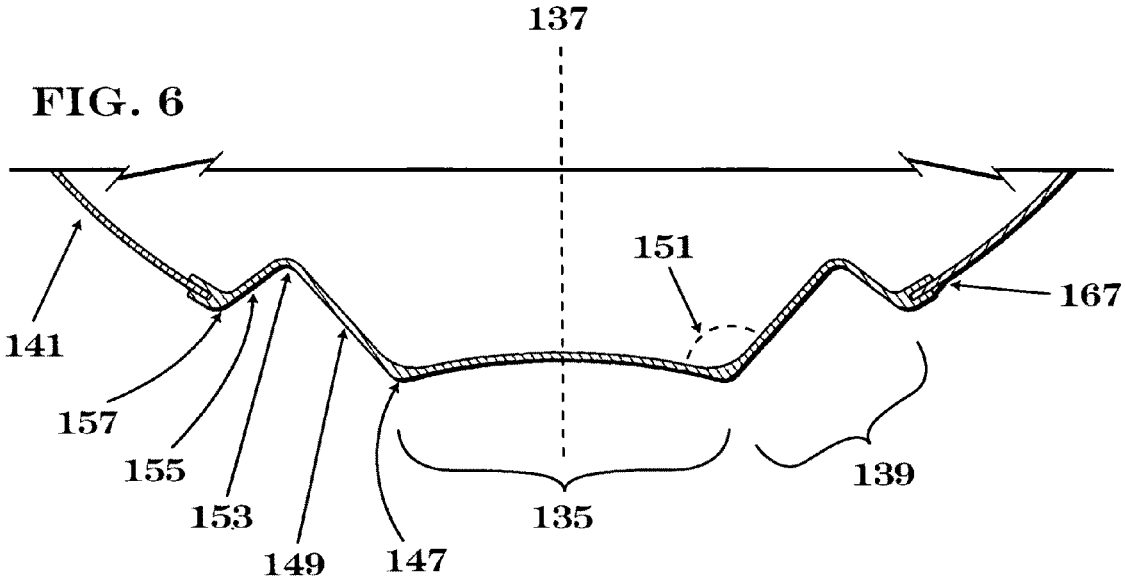
FIG. 6 is a cut away view of the pontoon with integrated lifting strake along the line 6-6 of FIG. 4.

Referring now to FIGS. 4-6, the apparatus of the invention comprises a pontoon with integrated lifting strake ("PILS") 133. PILS 133 generally comprises five main elements: improved running surface 135 divided by improved running surface centerline 137, integrated lifting strakes 139, flotation cavity wall 141, nose 143, and end 145. The transverse edges of improved running surface 135 are formed by two sponsons 147. Proximal lifting strake surfaces 149 of integrated lifting strakes 139 are bound on the proximal edge by sponsons 147, and proximal lifting strake surfaces 149 form an obtuse sponson angle 151 with improved running surface 135. The transverse edges of proximal lifting strake surfaces 149 are bounded on the side opposite of sponsons 147 by proximal lifting strake edges 153. Proximal lifting strake edges 153 bound the proximal transverse side of distal lifting strake surfaces 155. Distal lifting strake edges 157 bound the exterior transverse side of distal lifting strake surfaces 155 and the proximal transverse side of flotation cavity wall 141. Distal lifting strake surfaces 155 are angled such that an imaginary line through the transverse profile of distal lifting strake surfaces 155, when bisecting transverse centerline 159, forms an acute lifting strake angle 161. The integrated lifting strakes 139 thus formed create two distal concave running surfaces on PILS 133, in addition to improved running surface 135.

Nose 143 may be a nose cone 117 of the prior art but is separately named to illustrate the differences between the nose cone 117 of the prior art with the advancements made by virtue of the manufacturing processes disclosed herein. Preferably, as shown in FIG. 4, nose 143 is formed so that the rear nose edge 163 of nose 143 that mounts to PILS 133 has a cross-sectional profile substantially similar to PILS 133 so that nose 143 will mount flush with PILS 133; such configuration allows nose 143 to contribute to the lifting action of improved running surface 135. Even more preferably, nose 143 is press formed so that there is no nose cone center weld seam 127 dividing nose 143.

Similarly, end 145 may be a rear end cap 121 of the prior art but is separately named to illustrate the differences between the methods disclosed herein and the prior art. Preferably, as shown in FIG. 5, end 145 is formed to have a cross-sectional profile substantially similar to PILS 133 so that end 145 will mount flush with PILS 133.

The accompanying drawings show obtuse sponson angle 151 as equal on both transverse sides of PILS 133 and acute lifting strake angle 161 as equal on both transverse sides of PILS While such a configuration may be preferable in some situations, such as where PILS 133 is installed along the longitudinal centerline of a pontoon boat, the inventors intend no such limitation on the apparatus disclosed herein or the associated methods. Rather, the inventors contemplate that obtuse sponson angle 151 may be different on the two transverse sides of PILS 133, and acute lifting strake angle 161 likewise may be different on the two transverse sides of PILS 133. For example, obtuse sponson angle 151 may be less obtuse, and acute lifting strake angle 161 may be more acute, on the transverse side of PILS 133 proximal to the longitudinal centerline of a pontoon boat, which deepens the concavity of improved running surface 135 proximal to the longitudinal centerline of the pontoon boat. Conversely, obtuse sponson angle 151 may be more obtuse, and acute lifting strake angle less acute, on the transverse side of PILS 133 distal to the longitudinal centerline of the pontoon boat, which shallows the concavity of improved running surface 135 distal to the longitudinal centerline of the pontoon boat. Deeper concavity of the improved running surface 135 proximal to the longitudinal centerline of a pontoon boat, taken alone or in conjunction with shallower concavity of the improved running surface 135 distal to the longitudinal centerline of a pontoon boat, assists with cornering and stability of a pontoon boat by forcing the boat to plane primarily on the improved running surface 135 and integrated lifting strake 139 distal to the centerline of the pontoon boat.

PILS 133 provides a number of advantages over the prior art. When a pontoon outfitted with PILS 133 is in the water, PILS 133 resembles a prior art pontoon 105. However, PILS 133 provides improved performance and better fuel economy because when under power PILS 133 planes on top of the water by forcing water downward, rather than pushing water to the side like prior art pontoon 105. Further, PILS 133 assists with trailering, as improved running surface 135 provides a convenient location for communicating with the cradle of a boat trailer.

Persons having ordinary skill in the art will recognize that PILS 133 may be formed from metal according to the methods presented below, may be cast from molded fiberglass, may be constructed of wood or other traditional materials, or may be made using other materials and methods suitable for marine use.

The method associated with PILS 133 has five preferred embodiments. Referring now to FIGS. 7-10, the first preferred embodiment utilizes an insert 165 comprised of improved running surface 135 and integrated lifting strakes 139, inclusive of distal lifting strake edges 155. Insert 165 may be constructed such that sponsons 147, proximal lifting strake edges 153, and/or distal lifting strake edges 157 are reinforced with thicker substrate material to prevent damage to PILS 133 during trailering, if the pontoon boat runs aground, or other circumstances where insert 165 is likely to come into contact with hard surfaces. Distal lifting strake edges 157 have flange 167 for receiving flotation cavity wall 141. Flotation cavity wall 141 is inserted into flange 167 one at a time, after which the seams between flotation cavity walls 141 and flange 167 are waterproofed. Preferably, PILS 133 according to the first preferred embodiment is constructed of metal, and even more preferably aluminum, and the seams between flotation cavity walls 141 and flange 167 are welded to form a watertight seal. Nose 143 and end 145 are attached to opposite longitudinal ends of flotation cavity walls 141 and insert 165 to form PILS 133.

Figure 7:
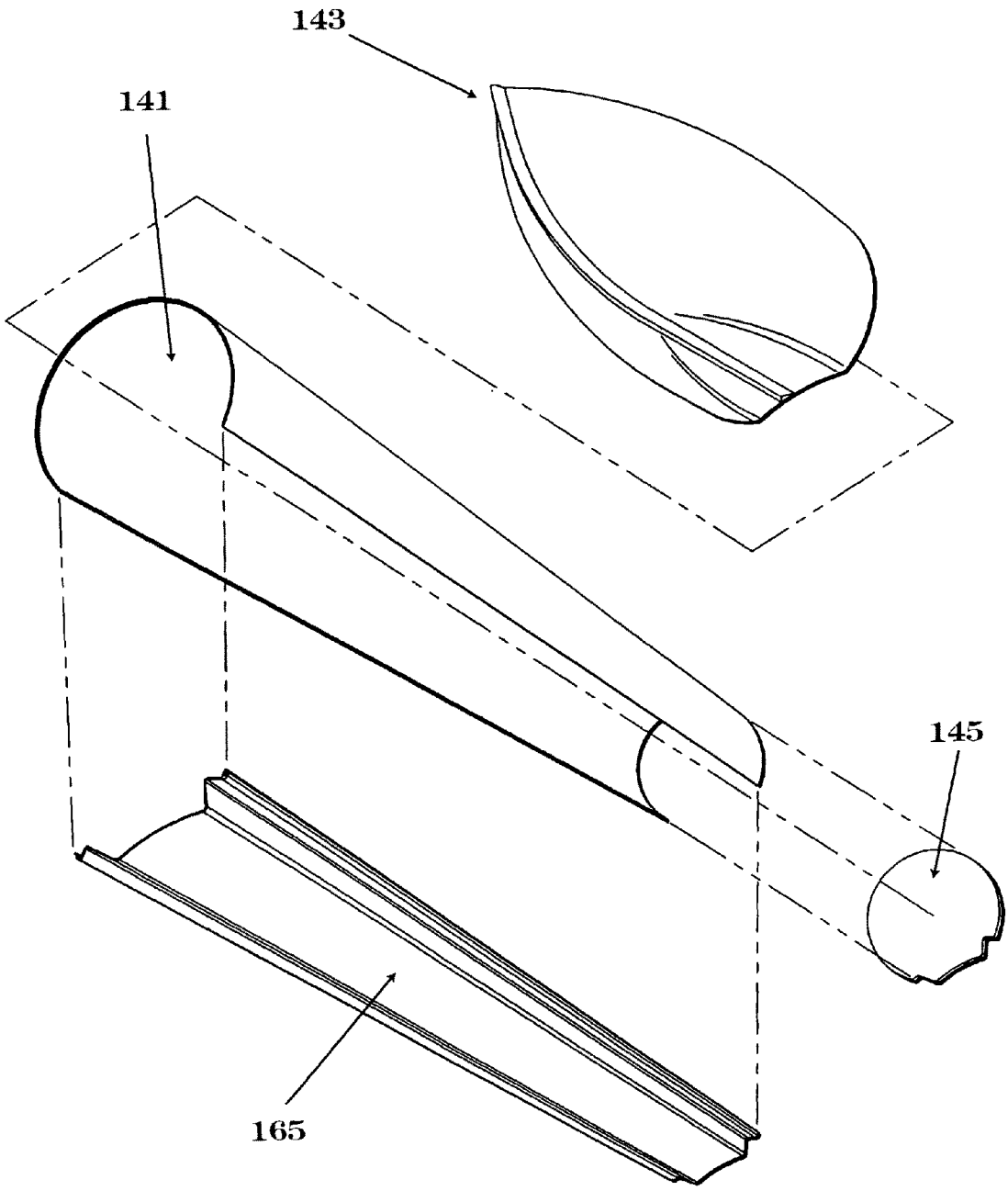
FIG. 7 is an exploded view of the pontoon with integrated lifting strake constructed in accordance with the first preferred embodiment of the invention.
Figure 8:
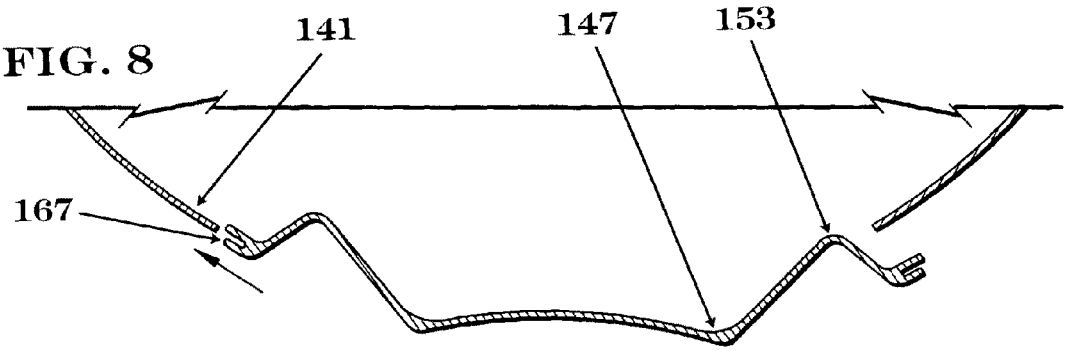
FIGS. 8-10 are a cut away view of the pontoon with integrated lifting strake along the line 6-6 of FIG. 4, and depict the method of construction of the first preferred embodiment of the invention.
Figure 9:
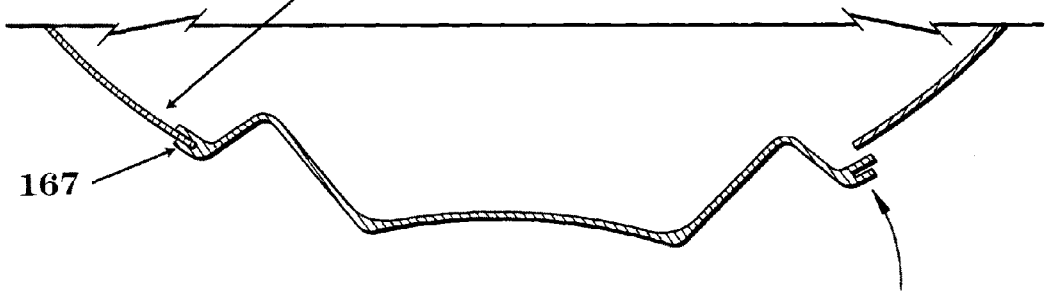
Figure 10:
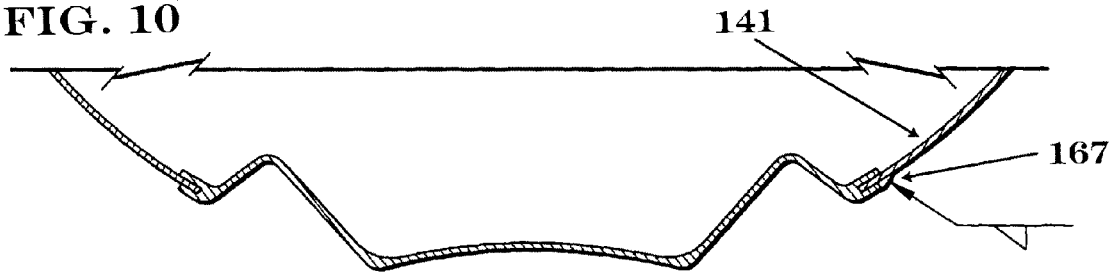

The first preferred embodiment has the added benefit of allowing the invention to be retrofitted to pontoons 105 of the prior art. In order to do so, nose cone 117 and rear end cap 121 of pontoon 105 are removed. Then, a rectangular piece is longitudinally removed (not shown) from the bottom of pontoon 105 to form flotation cavity walls 141 as shown in FIG. 7. The removed rectangular piece may optionally be used to form insert 165, or insert 165 may be formed from raw material. Insert 165 is mounted to flotation cavity walls 141, and nose 143 and end 145 are attached thereto, according to the method of the first preferred embodiment. Preferably, nose cone 117 and rear end cap 121 can be used as nose 143 and end 145 with only slight modification so that the transverse edges of nose 143 and end 145 align with the transverse edges of improved running surface 135 and integrated lifting strake 139.

Turning now to FIGS. 11-14, the second preferred embodiment is formed from a single sheet of metal 169, preferably aluminum or an alloy thereof. Sheet 169 has two longitudinal edges 171 and two transverse edges 173. Improved running surface 135 and integrated lifting strakes 139 are formed into the longitudinal surface of sheet 169. In the second preferred embodiment, the three concave surfaces corresponding to improved running surface 135 and integrated lifting strakes 139, as well as floatation cavity walls 141, are formed by bending sheet 169 along longitudinal lines at predetermined locations that correspond to sponsons 147, proximal lifting strake edge 153, and distal lifting strake edge 157. After all edges and surfaces are formed in sheet 169, a flotation cavity seam 175 will be present between longitudinal edges 171. Flotation cavity seam 175 must be filled to create a watertight flotation cavity seal 177, such as by welding. In the second preferred embodiment, watertight flotation cavity seal 177 will be above the waterline when PILS 133 is installed on a pontoon boat, and the above-water location is dictated by choosing a location for bending the longitudinal lines corresponding to sponsons 147 at a point where both sponsons 147 are substantially equidistant from the longitudinal centerline of sheet 169. Likewise, the two proximal lifting strake edges 153 are substantially equidistant from the longitudinal centerline of sheet 169, as are distal lifting strake edges 157. Nose 143 and end 145 are then attached to opposite transverse edges 173 to form PILS 133.

The second preferred embodiment has numerous advantages over the prior art. The second preferred embodiment provides PILS 133 that requires only one longitudinal weld, whereas prior art pontoons 105 with longitudinal strakes 111 required one longitudinal weld for the pontoon 105 and four additional longitudinal strake welds 113 for longitudinal strakes 111, for a total of not less than five longitudinal welds. Fewer welds provides fewer potential failure points on PILS 133 than prior art pontoons 105. Further, the second preferred embodiment has no welds below the waterline, while prior art pontoon 105 has at least two longitudinal strake welds 113 below the waterline when pontoon boat 101 is on plane and at least four longitudinal strake welds 113 below the waterline when pontoon boat 101 is not on plane.

Figure 15:
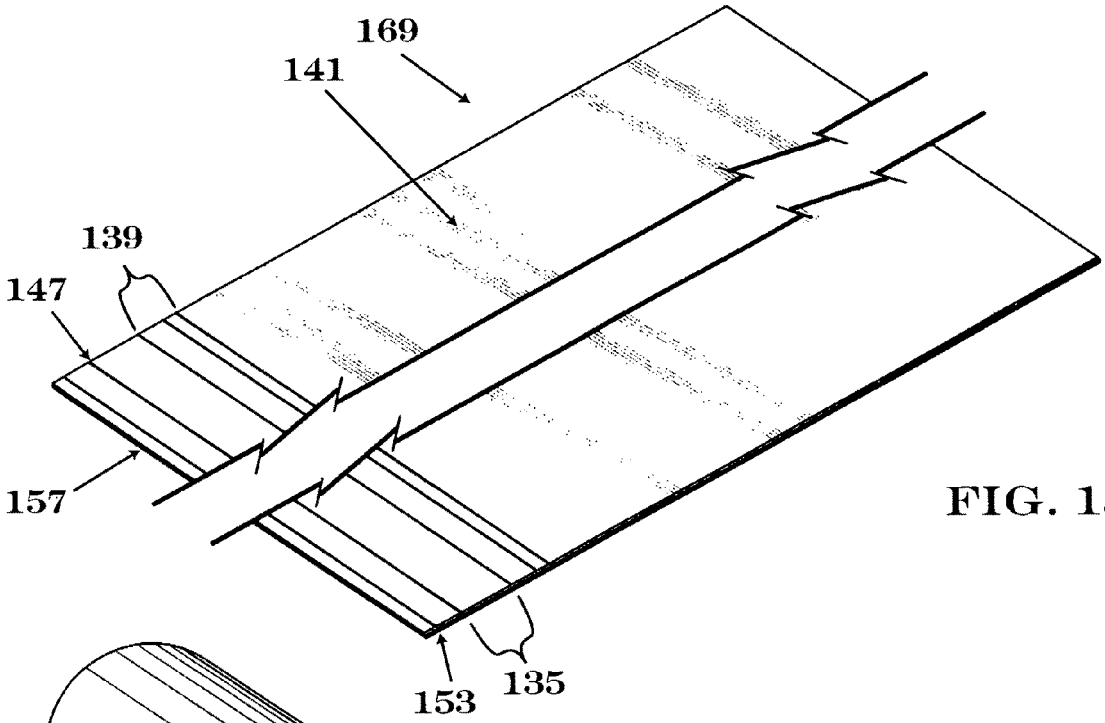
FIG. 15 is a perspective view of a piece of material and the several bend points used to construct the pontoon with integrated lifting strake according to the third preferred embodiment of the invention.
Figure 16:
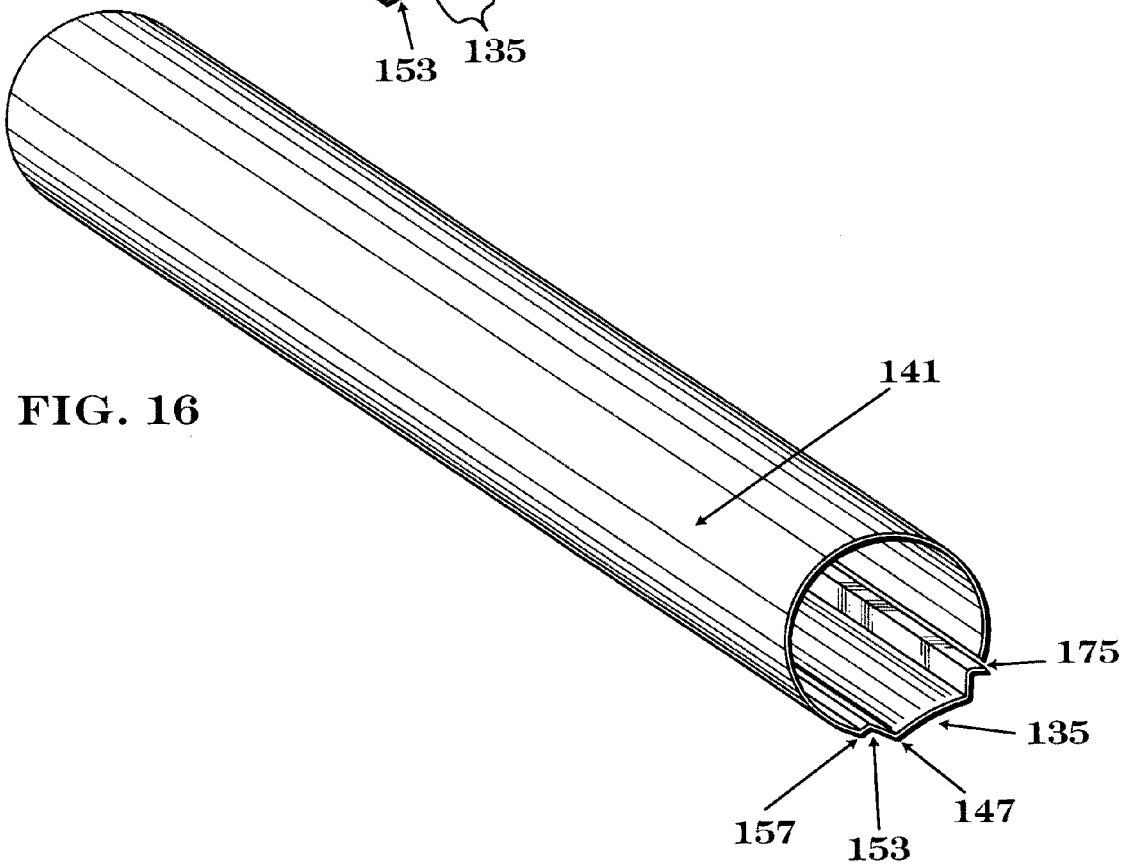
FIG. 16 is a perspective view of the pontoon with integrated lifting strake being rounded into a pontoon shape according to the third preferred embodiment of the invention.
Figure 17:
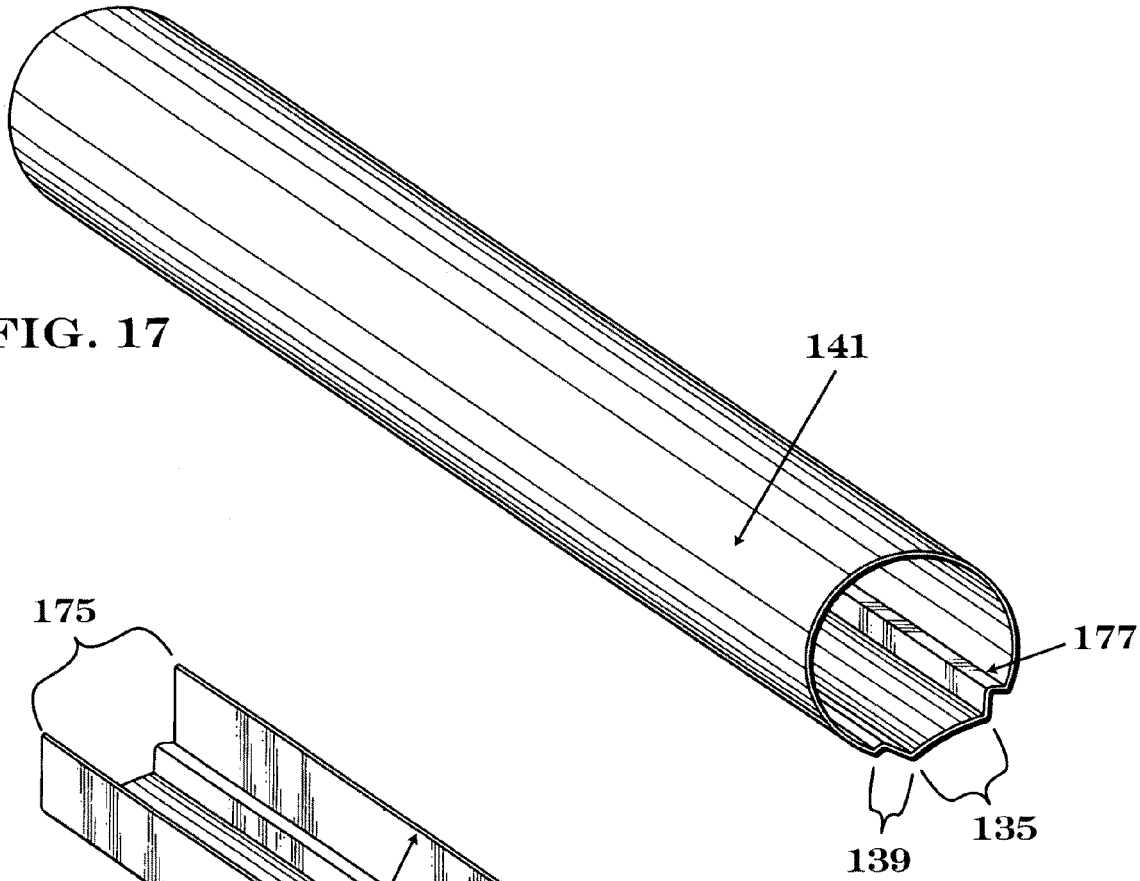
FIG. 17 is a perspective view of the pontoon with integrated lifting strake according to the third preferred embodiment of the invention before installation of the nose cone and end cap.

Turning now to FIGS. 15-17, the third preferred embodiment demonstrates that the location of flotation cavity seam 175 and the corresponding flotation cavity seal 177 can be arbitrarily chosen at any longitudinal location on sheet 169, depending on where bends and curves are made in sheet 169 to form improved running surface 135 and integrated lifting strakes 139. The location for seam can be chosen to correspond to the location for a sponson 147, proximal lifting strake edge 153, or distal lifting strake edge 157, which eliminates the need for one bend in sheet 169; such is the case in the third preferred embodiment, where the location of flotation cavity seam 175 and flotation cavity seal 177 corresponds to distal lifting strake edge 157. While the third preferred embodiment is an example of an arbitrary choice of location for flotation cavity seam 175 and flotation cavity seal 177, it should be noted that the particular choice of location presented in the third preferred embodiment represents a tradeoff between the benefit of ease of manufacturing by reducing the number of bends that must be made and the consequence of having the full length of a longitudinal weld under water.

Figure 11:
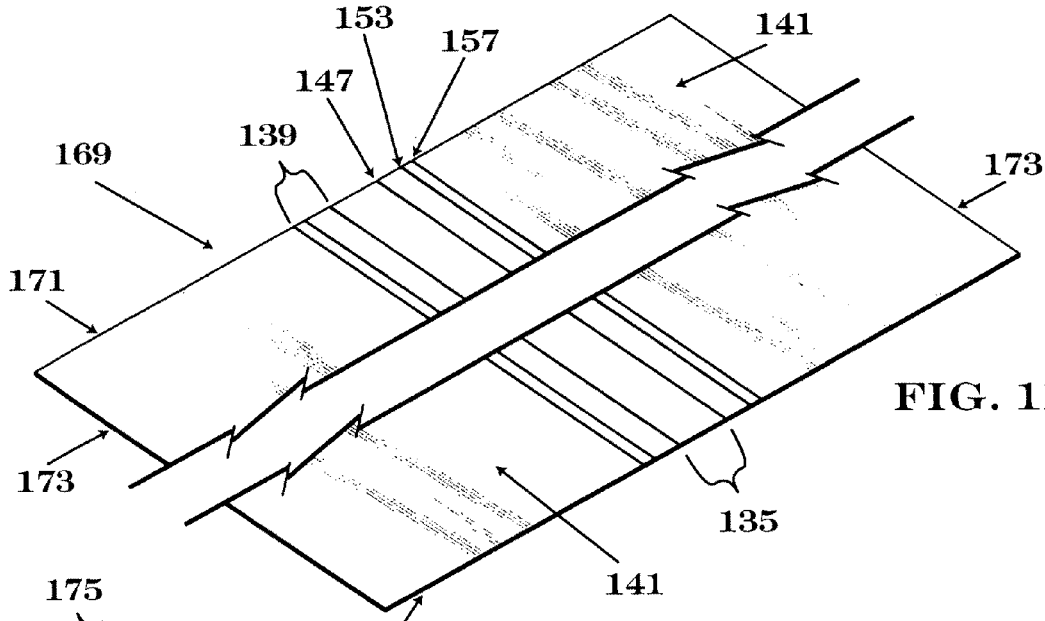
FIG. 11 is a perspective view of a piece of material and the several bend points used to construct the pontoon with integrated lifting strake according to the second preferred embodiment of the invention.
Figure 12:
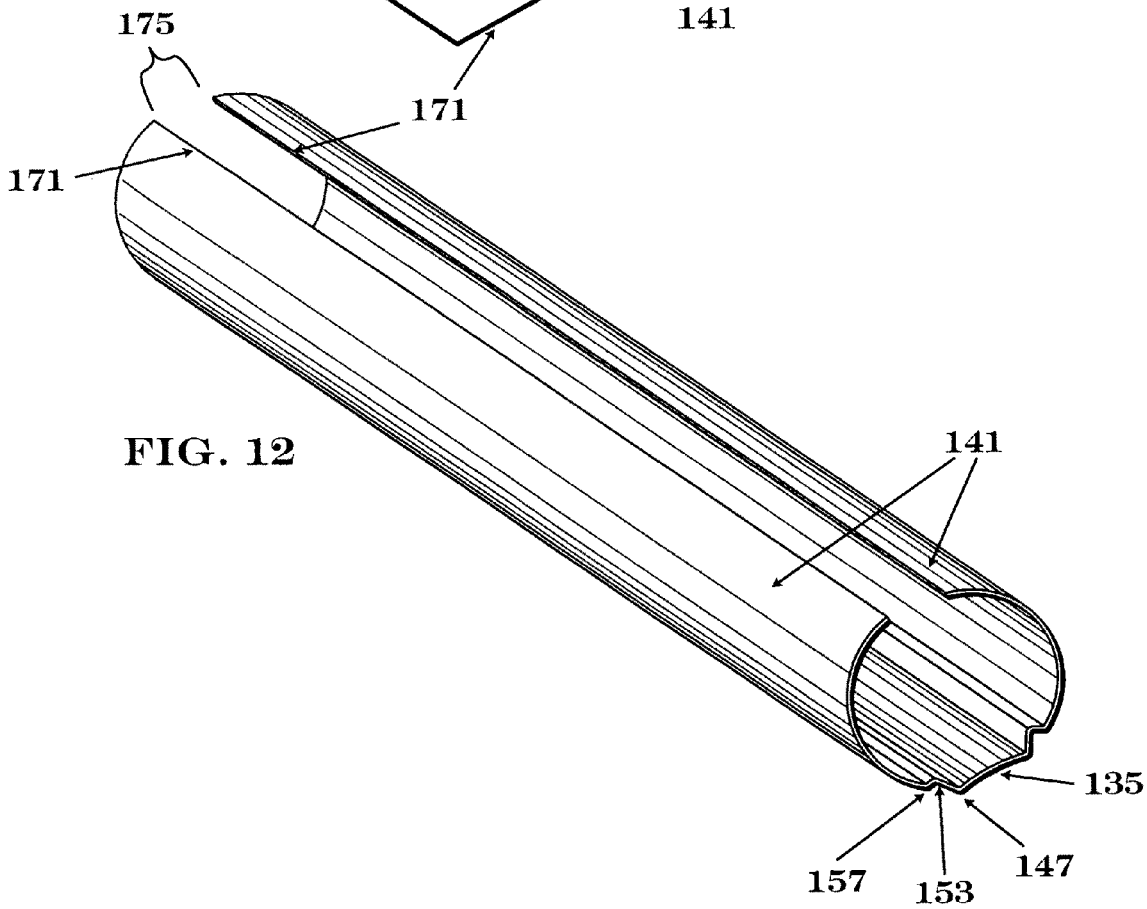
FIG. 12 is a perspective view of the pontoon with integrated lifting strake being rounded into a pontoon shape according to the second preferred embodiment of the invention.
Figure 13:
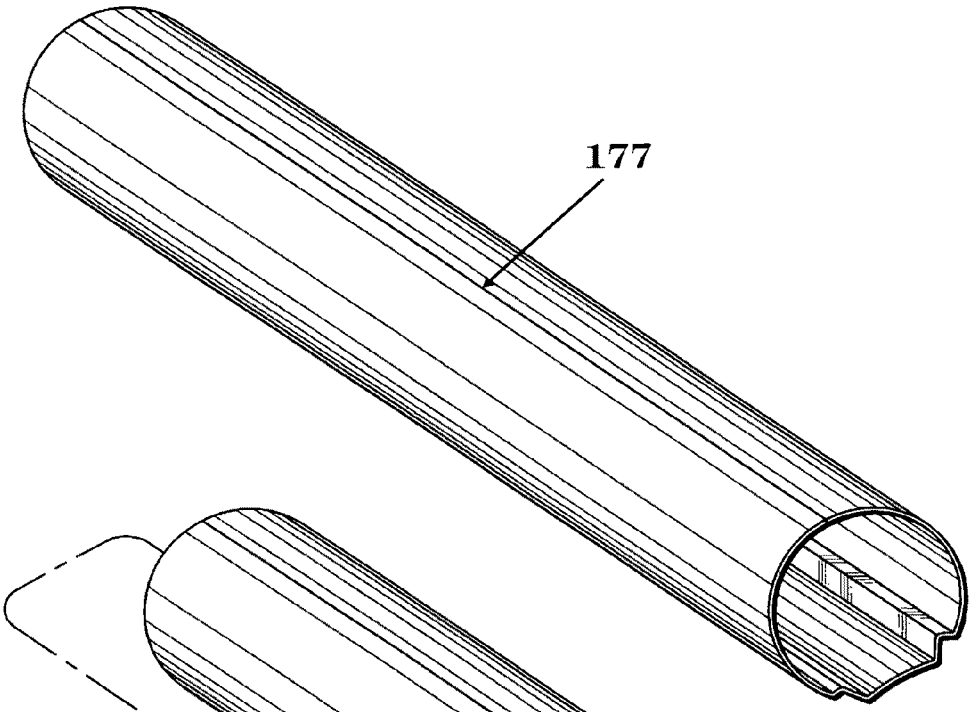
FIG. 13 is a perspective view of the pontoon with integrated lifting strake according to the second preferred embodiment of the invention before installation of the nose cone and end cap.
Figure 14:
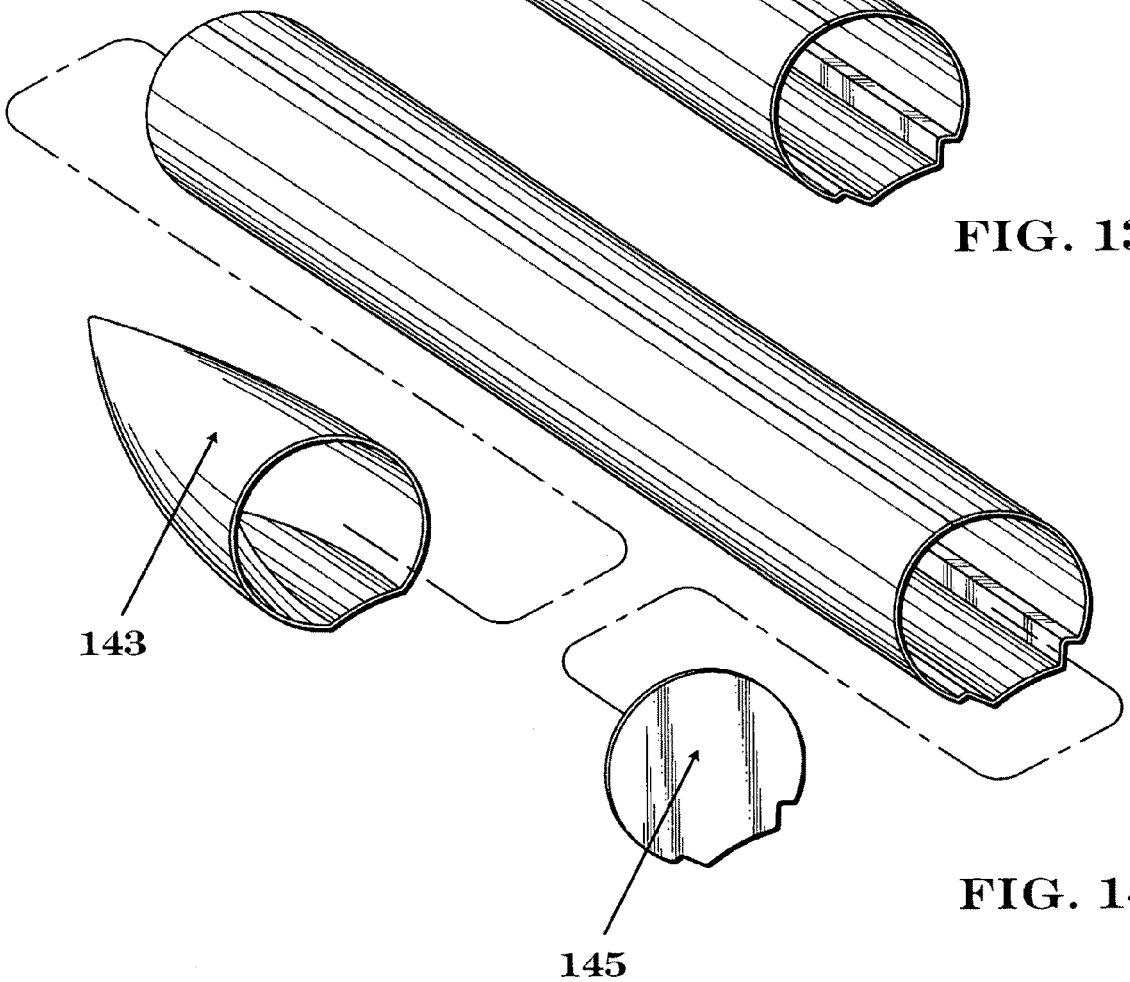
FIG. 14 is a perspective view of the pontoon with integrated lifting strake according to the second preferred embodiment of the invention showing installation of the nose cone and end cap.
Figure 18:
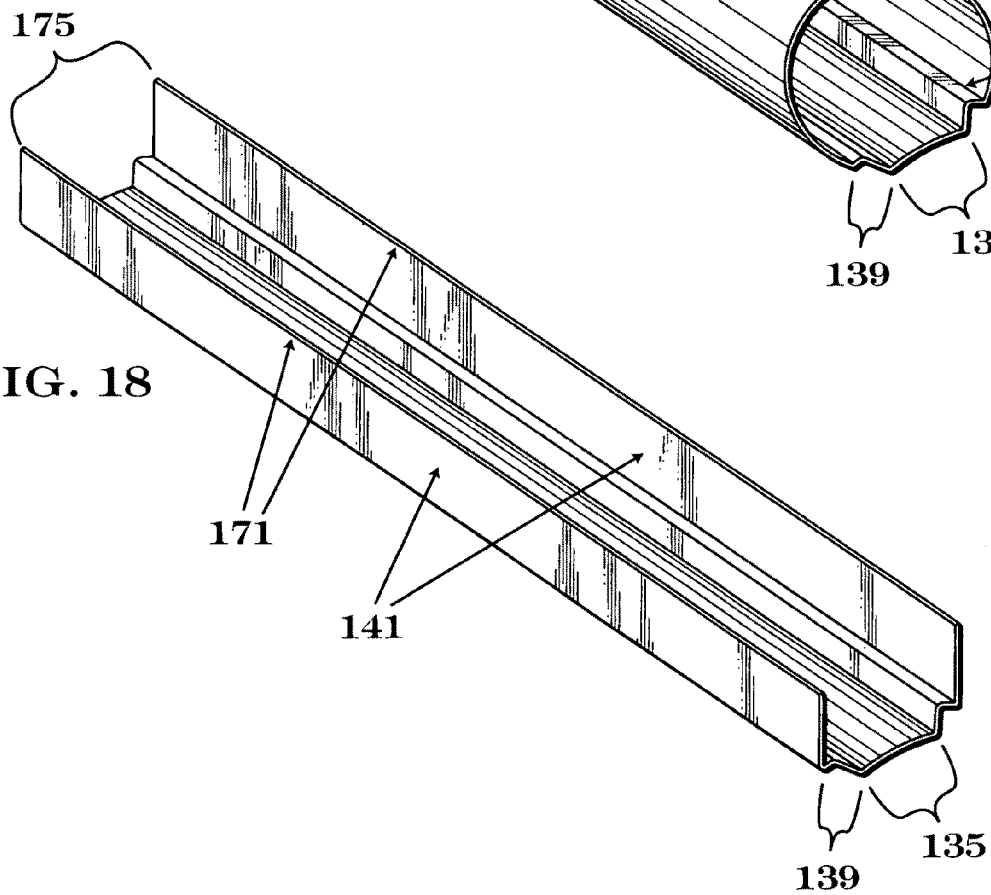
FIG. 18 is a perspective view of the pontoon with integrated lifting strake after being formed into shape according to the fourth preferred embodiment of the invention.

Turning now to FIGS. 18-19, the fourth preferred embodiment is made from sheet 169 as shown in FIG. 11, wherein the longitudinal centerline of sheet 169 corresponds to the longitudinal centerline of improved running surface 135 such that after bending the longitudinal halves of sheet 169 mirror one another. Accordingly, after improved running surface 135 and integrated lifting strakes 139 have been formed, flotation cavity walls 141 are the same height. Longitudinal edges 171 are then secured directly to deck 179 to form two flotation cavity seals 177, both of which are above the waterline. Optionally, longitudinal edges 171 can be flanged and drilled to provide a greater surface area for securing PILS 133 to deck 179. As with previously discussed embodiments, the fourth preferred embodiment requires a nose 143 and end 145 that are attached to opposite transverse edges 173 to form PILS 133.

While the fourth preferred embodiment shows each flotation cavity wall 141 as substantially perpendicular to deck 179, the inventors contemplate that the wall may be curved or shaped otherwise as necessary to provide appropriate pontoon boat flotation and performance; the utility of the fourth preferred embodiment lies primarily in the attachment of PILS 133 directly to deck 179.

The fourth preferred embodiment provides many advantages over the prior art. For instance, the fourth preferred embodiment eliminates mounting braces 107 between prior art pontoons 105 and deck 103. Not only does this represent a weight savings that allows better overall boat performance, it also lowers the center of gravity of the pontoon boat, which provides better stability in rough seas. Furthermore, by combining the fourth preferred embodiment with a pontoon boat deck such as the one disclosed in commonly-owned U.S. Pat. No. 7,188,576, several steps in the construction of the pontoon boat are consolidated, thus reducing manufacturing times and costs.

Turning now to FIGS. 20-22, the fifth preferred embodiment provides a PILS 133 that has a one-piece nose cap 181. W-shaped tab 183 is removed from sheet 169 at the transverse edge 173 of sheet 169 corresponding to the bow of PILS 133. Thereafter sheet 169 is bent and curved in a manner substantially similar to the second preferred embodiment. After flotation cavity seal 177 is formed, nose cap 181 is secured to transverse edge 173. The removal of W-shape tab 183 results in the longitudinal length of the bottom of PILS 133 being shorter than the top of PILS 133 such that the plane of transverse edge 173 at the bow of PILS 133 is not perpendicular to the bottom surface of the pontoon. Rather, the plane of transverse edge 173 at the bow of PILS 133 and the transverse centerline form an acute angle, with the open end pointing towards the bow of the pontoon boat.

As shown in the fifth preferred embodiment, nose cap 181 is substantially planar. Optionally, nose cap 181 may be formed into arbitrary non-planar shapes, such as, for example, a V-shape formed with a bend at the longitudinal centerline of nose cap 181. In order for transverse edge 173 to receive non-planar nose cap 181, tab 183 must be modified accordingly. For instance, a V-shaped nose cap 181 would require a substantially U-shaped tab 183, as opposed to a W-shaped tab 183 for planar nose cap 181. A V-shape nose cap 181 allows PILS 133 to closely resemble prior art pontoon 105 while retaining the same manufacturing advantages provided by the fifth preferred embodiment.

The fifth preferred embodiment addresses a deficiency in the design of prior art pontoons by spreading the force of oncoming water over the welds securing one-piece nose cap 181. That is, water pressure 185 applies force to nose cap 181 in a direction perpendicular to the seam between nose cap 181 and transverse edge 173. Therefore, the force applied to nose cap 181 is spread substantially evenly over nose cap 181 and the seam between nose cap 181 and transverse edge 173. Furthermore, the fifth preferred embodiment provides an advantage of the prior art in that nose caps 183 are easier to manufacture and install than nose cones 117 because nose caps 183 are made of one piece, rather than two nose cone halves 125 that must be welded together. Assembly is also easier with nose caps 183 because PILS 133 is preferably installed to deck 179 upside down; that is, the bottom of deck 179 faces upward, and the top part PILS 133 rests on deck 179 during assembly. Thus, the angle of transverse edge 173 at the bow of PILS 133 faces upward, and nose cap 181 can rest on transverse edge 173 with minimal securing means during assembly.

Persons having ordinary skill in the art will recognize that edges may be formed in sheet 169 using a press brake or other similar machine. Curves may be formed in sheet 169 by use of a plate roll or other similar machine. Curves are typically formed into sheet 169 prior to edges being formed, as a plate roll is easier to operate when no edges interfere with the sheet feeding mechanism of the plate roll. Thus, in preferred embodiments two through five, flotation cavity wall 141 on one transverse side of sheet 169 is typically curved first, followed by improved running surface 135, then by flotation cavity wall on the opposite transverse side of sheet 169. Sheet 169 is then fed into a press brake, which is used to form sponsons 147, proximal lifting strake edges 153, and distal lifting strake edges 157. Of course, persons skilled in the art will also recognize that curved surfaces can be replaced with other geometric shapes so that the only equipment necessary to manufacture the pontoon with integrated lifting strake is a press brake. For instance, five sides of a regular hexagon or seven sides of a regular nonagon could serve as flotation cavity wall 141.

While the inventors have described above what they believe to be the preferred embodiments of the invention, persons having ordinary skill in the art will recognize that other and additional changes may be made in conformance with the spirit of the invention and the inventors intend to claim all such changes as may fall within the scope of the invention.

We claim:

1. A method of manufacturing a pontoon having an improved running surface, comprising the steps of:

supplying a sheet material having a longitudinal axis, a transverse axis, a first longitudinal edge, a second longitudinal edge, a bow transverse edge, and a stern transverse edge;

forming the sheet material by imprinting along the longitudinal axis of the sheet of material a concave running surface;

further forming the sheet material by imprinting along the longitudinal axis of the sheet material two concave integrated lifting strakes each having a proximal lifting strake surface, proximal lifting strake edge, distal lifting strake surface, and distal lifting strake edge, such that the concave integrated lifting strakes join the concave main running surface at two sponsons;

further forming the sheet material by imprinting along the longitudinal axis of the sheet material one or more flotation cavity walls, such that the flotation cavity wall joins the integrated lifting strakes at the distal lifting strake edges;

forming one or more seams along the first and second longitudinal edges;

adjoining to the bow transverse edge a nose; and adjoining to the stern transverse edge an end.

2. The method of claim 1, wherein the running surface is formed into a longitudinal centerline of the sheet material and the first and second longitudinal edges are joined to form the seam.

3. The method of claim 1, wherein the first longitudinal edge forms one edge taken from the group of the sponsons, the proximal lifting strake edges, or the distal lifting strake edges.

4. The method of claim 1, wherein the running surface is formed into a longitudinal centerline of the sheet material to form two flotation cavity walls of substantially equal height, and the first and second longitudinal edges are joined to a deck to form two seams.

5. The method of claim 1, wherein a tab is removed from the bow transverse edge such that after the seam is formed along the first and second longitudinal edges, the angle between the bow transverse edge and the running surface is acute, and a one-piece nose is joined to the bow transverse edge.

6. A method of manufacturing a pontoon having an improved running surface, comprising the steps of:

forming a longitudinal insert, further comprising a concave running surface, two concave integrated lifting strakes that join the concave running surface at two sponsons, and two flanges that join the concave integrated lifting strakes at two distal lifting strake edges;

securing the two flanges to a flotation cavity wall; and securing a nose and end to opposite longitudinal ends of the insert and flotation cavity wall.

7. The method of claim 6, wherein the two concave integrated lifting strakes further comprise a proximal lifting strake surface, proximal lifting strake edge, and a distal lifting strake surface.

8. The method of claim 6, wherein the two concave integrated lifting strakes further comprise a proximal lifting strake surface, a proximal lifting strake edge, a distal lifting strake surface such that the angle between the concave running surface and the proximal lifting strake surface is obtuse.

9. The method of claim 6, wherein the pontoon has a transverse centerline and the two concave integrated lifting strakes further comprise a proximal lifting strake surface, a proximal lifting strake edge, a distal lifting strake surface, and a distal lifting strake edge, such that the angle between the distal lifting strake surface and the transverse centerline of the pontoon is acute.

10. The method of claim 6, wherein the pontoon has a transverse centerline and the two concave integrated lifting strakes further comprise a proximal lifting strake surface a proximal lifting strake edge, a distal lifting strake surface, and a distal lifting strake edge, such that the angle between the concave running surface and the proximal lifting strake surface is obtuse and the angle between the distal lifting strake surface and the transverse centerline of the pontoon is acute.

11. The method of claim 6, wherein any of the insert, flotation cavity wall, nose, or end is constructed from a pre-existing pontoon.

* * * * *